United States Patent [19]

Theurer

[11] 4,165,693

[45] Aug. 28, 1979

[54] MOBILE TRACK LEVELING, LINING AND TAMPING APPARATUS

[75] Inventor: Josef Theurer, Vienna, Austria

[73] Assignee: Franz Plasser Bahnbaumaschinen-Industriegesellschaft m.b.H., Vienna, Austria

[21] Appl. No.: 858,717

[22] Filed: Dec. 8, 1977

[30] Foreign Application Priority Data

Jan. 17, 1977 [AT] Austria ..... 238/77

[51] Int. Cl.[2] ..... E01B 27/17; E01B 29/04

[52] U.S. Cl. ..... 104/7 B; 104/12

[58] Field of Search ..... 104/1 R, 2, 7 R, 7 A, 104/7 B, 8, 12

[56] References Cited

U.S. PATENT DOCUMENTS

| | | | |
|---|---|---|---|
| Re. 27,604 | 3/1973 | Stewart et al. | 104/12 |
| 3,389,469 | 6/1968 | Plasser et al. | 104/8 X |
| 3,469,534 | 9/1969 | Plasser et al. | 104/12 X |
| 3,547,039 | 12/1970 | Plasser et al. | 104/8 |
| 3,706,284 | 12/1972 | Plasser et al. | 104/7 B |
| 3,744,428 | 7/1973 | Plasser et al. | 104/7 R X |
| 3,877,160 | 4/1975 | Plasser et al. | 37/104 |
| 4,031,625 | 6/1977 | Theurer | 104/8 X |
| 4,046,078 | 9/1977 | Theurer | 104/7 R |
| 4,046,079 | 9/1977 | Theurer | 104/12 X |

FOREIGN PATENT DOCUMENTS

| | | | |
|---|---|---|---|
| 1916281 | 10/1969 | Fed. Rep. of Germany | 104/12 |

*Primary Examiner*—Randolph A. Reese
*Attorney, Agent, or Firm*—Kurt Kelman

[57] ABSTRACT

A mobile track leveling, lining and tamping apparatus is constituted by a single machine assembly of a first vehicle mounted on two undercarriages and carrying therebetween a track correction unit and a tamping unit, a reference system for controlling the track correction, a first instrument for measuring the track position during correction and a second instrument for measuring the track position after correction, and a drive for the vehicle, and a second vehicle associated with and preceding the first vehicle in the working direction but being mechanically separated therefrom. A separate drive for the second vehicle enables the machine assembly to be operated while the first vehicle advances intermittently and the second vehicle advances non-stop. A ballast plow and an indicator for indicating and surveying the corrected track position are mounted on the second vehicle.

10 Claims, 2 Drawing Figures

MOBILE TRACK LEVELING, LINING AND TAMPING APPARATUS

Figure 1:
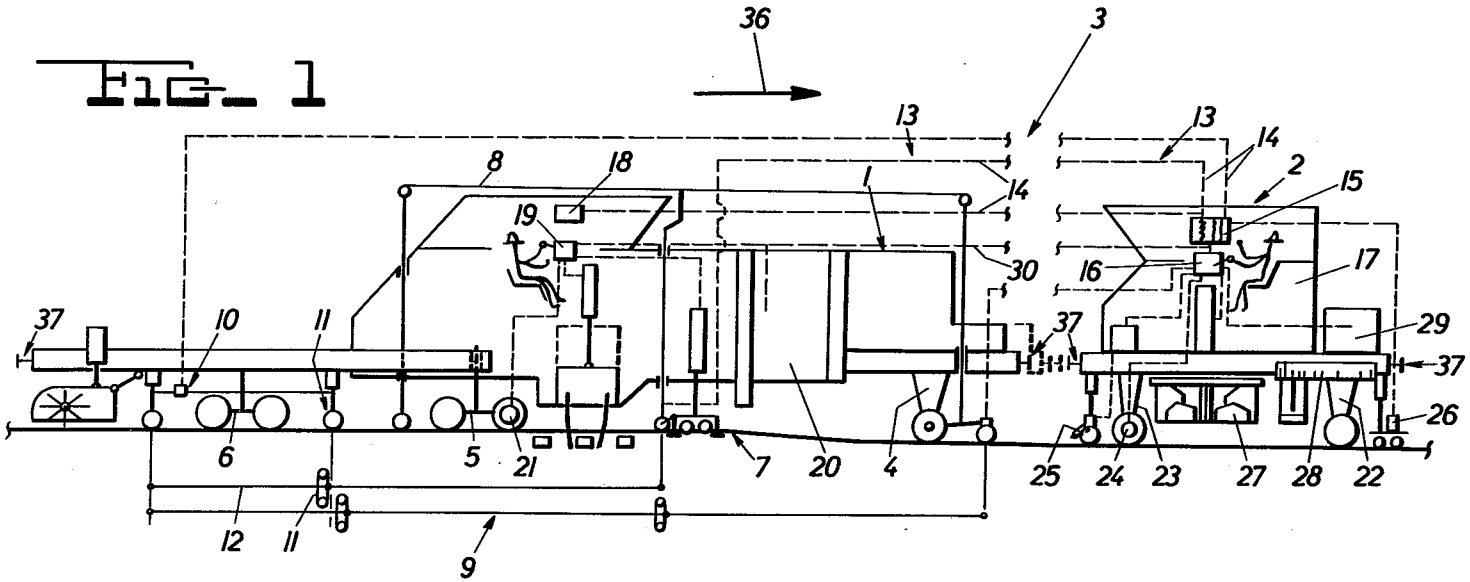

The present invention relates to improvements in a mobile track leveling, lining and tamping apparatus comprising a vehicle mounted on two undercarriages for mobility on the track in a working direction, track lifting, lining and tamping means mounted on the vehicle between the two undercarriages, a reference system for controlling the track leveling and lining by the track lifting and lining means, first means for measuring the track position during leveling and lining and second means for measuring the track position after leveling and lining on the vehicle, and a drive for the vehicle. A common power source is mounted on the vehicle for the drive and all operating means.

U.S. Pat. No. 3,469,534, dated Sept. 30, 1969, discloses such an apparatus wherein the frame means comprises a main frame mounting a tamping head and an auxiliary frame mounted on two undercarriages, one end of the main frame being adjacent one end of the auxiliary frame, and a pivotal coupling between the ends of the main and auxiliary frames. The track shifting means and surface tamping means are mounted on the auxiliary frame to enable the ballast tamped by the tamping head to be further compacted by the trailing surface tamping means so that the corrected track is securely held in position by the twice-tamped ballast. This machine has been very successful in practical operations but the track surfacing means on the auxiliary frame cannot operate continuously since the auxiliary frame is intermittently stopped with the main frame as the machine advances from tamping station to tamping station.

U.S. Pat. No. 4,046,078, dated Sept. 6, 1977, discloses another mobile track surfacing apparatus comprising a main frame and a trailing auxiliary frame. The main frame supports a first tamping head and the auxiliary frame supports a second tamping head, the adjacent ends of the frames being coupled for adjustment in the working direction.

The auxiliary frame is disclosed solely as a support for the additional tamping head and no other use is suggested therefor. While the spacing between the frames is adjustable, the two frames are advanced in unison along the track. The use of two successive tamping heads makes the control of the corrected track more difficult, particularly because the two frames execute different movements with respect to the track movements during correction.

In the track surfacing machine of U.S. Pat. No. 4,031,625, dated June 28, 1977, a forward car accommodating the work crew is coupled to the main frame of a generally conventional mobile track leveling, lining and tamping apparatus.

German Published Application (Offenlegungsschrift) No. 1,916,281, published Oct. 23, 1969, discloses a mobile track surfacing machine wherein a trailing auxiliary frame is coupled to a machine main frame. The trailer supports rolls for compacting the ballast along the sides of the track and these compacting rolls can be repositioned on the trailing auxiliary frame in the working direction. This is an expensive structure because it requires an adjustable mounting for each surfacing tool and also a very sturdy construction of the auxiliary frame since it must be capable of supporting the compacting rolls along most of its length. No control for the surfaced track is provided.

It is the primary object of this invention to provide a mobile track leveling, lining and tamping apparatus of the indicated type wherein the surfacing operations can be controlled with greater accuracy to obtain a better track quality and wherein the individual surfacing operations may be effected independently of each other and without interfering with each other.

The above and other objects are accomplished in accordance with the invention by forming a single machine assembly of the above-mentioned first vehicle and a second vehicle associated with and preceding but mechanically separated from the first vehicle, and providing a separate drive for the second vehicle whereby the machine assembly may be operated while the first vehicle advances intermittently and the second vehicle advances non-stop. A ballast plow means is mounted on the second vehicle as is an indicating means for indicating and surveying the track position leveled and lined at the first vehicle. A common power source is provided on the first vehicle for the drives and the operating means for the indicating means. The operating means may be electrical, mechanical or wireless. Preferably, means is mounted on the second vehicle for applying colored markers along the track for facilitating the lining operation and/or the centering of the track tamping means over respective ties.

This arrangement provides a considerable improvement in indicating, recording, observing and storing the individual track measuring parameters obtained in the uncorrected and the corrected track sections since the two vehicles of the machine assembly are mechanically separated. In view of this and since the second vehicle has its separate drive, the transmission of vibrations and particularly the influences of intermittent acceleration phenomena on the indicating, measuring and control instruments on the second vehicle are avoided during the continuously proceeding track surfacing operation. This exact indication and control, as well as the possibility of recording, all the measuring parameters also make it possible to use immediate visual control from a cab on the second vehicle and thus enables an operator there to make all necessary adjustments that may be required. In this connection, it is possible to proceed in the manner more fully described in my copending application Ser. No. 858,718 filed concurrently and entitled "Mobile Track Leveling, Lining and Tamping Apparatus," whose entire disclosure is incorporated herein by way of reference, which enables the trend of the track alignment to be indicated and controlled on the basis of colored markers along the track. On the other hand, wireless, cable or mechanical transmission means transmit the track parameters measured at the first vehicle to the mechanically separated second vehicle where the operator will have them indicated, recorded and, if necessary, can correct them.

The vehicles used in the machine assembly of the present invention may be presently available vehicles so that the assembly may be constructed, after relatively minor adaptations, with a minimum of work, time and cost. Since the vehicles are mechanically separated, their individual movements within the single assembly may be readily controlled.

Figure 2:
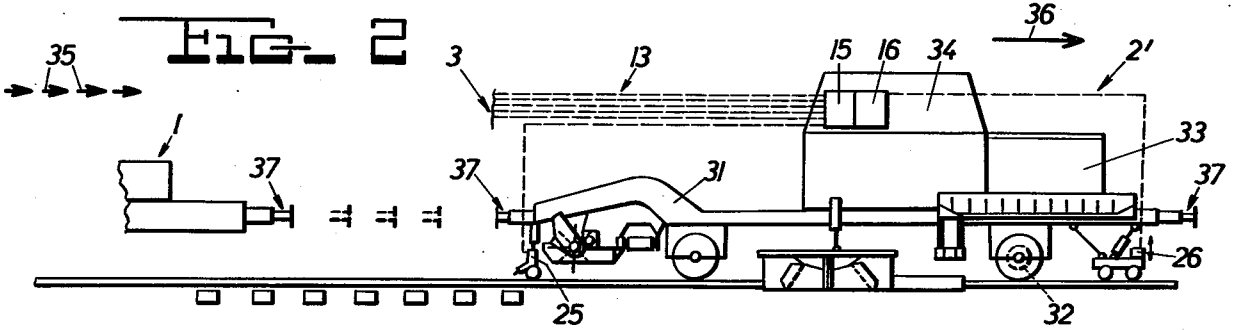

The above and other objects, advantages and features of this invention will become more apparent from the following detailed description of now preferred embodiments thereof, taken in conjunction with the accompanying schematic drawing wherein FIG. 1 is a side elevational view of a track leveling, lining and tamping apparatus comprised of a single machine assembly during a track surfacing operation, and FIG. 2 is a like view of another embodiment of such apparatus, only the second vehicle being shown in full while the first vehicle is represented merely by its front end.

Referring now to the drawing and first to FIG. 1, there is shown a mobile track leveling, lining and tamping apparatus comprised of single machine assembly 3 consisting of first vehicle 1 and second vehicle 2 which is associated with and precedes the first vehicle in the working direction indicated by arrow 36 but which is mechanically separated therefrom. First vehicle 1 consists of a main frame mounted for mobility on track 7 on undercarriages 4 and 5, and an auxiliary frame mounted for mobility on the track on undercarriage 6, the auxiliary frame being a trailer coupled to the main frame by a king pin in the region of rear undercarriage 5. Track lifting, lining and tamping means are mounted on the main frame between undercarriages 4 and 5, and a reference system 8,9 controls the track leveling and lining by the track lifting and lining means, all in a conventional manner too well known to require further description. The reference lines of the reference systems are anchored to measuring bogies which move with vehicle 1 and are pressed without play against a respective reference rail. Means 10, 11 are mounted on the bogies for measuring the corrected track position after leveling and lining. Measuring and surveying means 11 cooperates with reference line 12 for ascertaining the lining parameters, reference system 9 with reference lines 12 having been shown in plan view in FIG. 1 for better understanding. If desired, this measuring means may also be used for ascertaining the track grade parameters while measuring means 10 may be used to measure the track gage and/or the track camber, all in a well known manner. As has been disclosed more fully in my above-mentioned copending application, one of the measuring bogies in the corrected track section, particularly on the auxiliary frame, may carry television cameras or other means indicating the track lining in relation to colored markers indicating the desired lateral position of the track. As also diagrammatically indicated, the auxiliary frame carries a ballast broom for cleaning the surface of the corrected track.

Track position measuring and surveying means 10, 11 are connected to indicating and/or control means 15, 16 in operator's cab 17 on second vehicle 2 by any suitable electrical, mechanical or wireless transmission means 13 to transmit the measured parameters to the indicating and/or control means, such as cable 14 as an electrical operating means, a tackle as a mechanical operating means or a wave emitter as a wireless operating means. As shown, there also may be an operator's cabin on the first vehicle, including a control panel 19 in operative connection with control panel 16 in operator's cab 17 on the second vehicle, and a television camera 18 in operative connection with a television screen in cab 17. A common central power source 20 is connected to control panel 19 and control switches for the various operating elements of the apparatus, including drive 21 for vehicle 1.

Second vehicle 2 is associated with and precedes first vehicle 1 and is mounted for mobility on track 7 on undercarriages 22, 23, separate drive 24 for the second vehicle being associated with rear undercarriage 23 in the illustrated embodiment. The second vehicle is mechanically separated from the first vehicle and is self-propelled by drive 24. In a manner more fully described in the above-identified copending application, the second vehicle carries a paint spray nozzle 25 for applying colored markers indicating a desired track alignment and/or a track position measuring device 26 for surveying the uncorrected track position ahead of the track surfacing apparatus. In this way, it is possible to use the second vehicle, which is mechanically separated from the first vehicle and may proceed non-stop along the track while the first vehicle advances intermittently between respective tamping stations, for accurately surveying the uncorrected track while using the indicating, recording and control instruments 15, 16 on the second vehicle to best advantage and under the most favorable conditions. This greatly facilitates the observation of the track position and any developing trend in track alignment and changes therein, which in turn greatly improves the quality of the ensuing track correction.

Ballast plow means 27 is vertically adjustably mounted on second vehicle 2 below operator's cab 17 between its two undercarriages, this plow means being arranged to plow the ballast in the central region of the track between the rails thereof, and additional ballast plows 28 are mounted along the sides of the second vehicle to plow the ballast along the track shoulders. The central power source 20, which may be a hydraulic fluid sump if the various elements are hydraulically operated, may be connected to hydraulic drive 24 and hydraulic drives for operating plow means 27 and 28 by flexible hose 30. In addition, the second vehicle may carry its own and separate power source 29 connected to separate drive 24 and the plow means hydraulic drives for independently controlling the same from control panel 16 in cab 17. In this manner, it is possible not only to operate all drives centrally from the common power source on the first vehicle when the machine assembly moves along the track during a surfacing operation but the two vehicles of the machine assembly may be used universally under varying operating conditions since the second vehicle may be used separately and independently with its own power source simply for surveying the uncorrected track before the track is corrected and/or for planing the ballast bed independently of other track surfacing operations. Furthermore, an additional operating stage for obtaining an improved track surface may be avoided with this arrangement since it is possible to eliminate a second pass over the surfaced track section by a separate ballast plow. Thus, the correction of the track position, tamping to fix the corrected track in its position and ballast plowing may be done simultaneously and in a single pass.

As shown in the embodiment of FIG. 2, the second, self-propelled vehicle 2', which forms a single machine assembly with first vehicle 1, may be a ballast profiling and/or planing machine 31 with its own drive 32 and separate power source 33, such a mobile machine being capable of use separately from the assembly. The second vehicle carries measuring bogies mounting paint spray mechanism 25 and track position measuring device 26, respectively. Track position indicating and control devices 15, 16 are mounted in operator's cab 34, and these devices are, as described in connection with the embodiment of FIG. 1, in connection with track position measuring and control devices on first vehicle 1 by means of transmission means 13. Various positions of vehicle 1 in relation to vehicle 2 have been indicated by a showing of front coupling 37 in full and broken lines to indicate the intermittent advance of the first vehicle from tie to tie, i.e. from tamping station to tamping station, in the direction of arrows 35. While vehicle 1 moves forward intermittently during the track surfacing operation, machine 31 with its ballast plow means 27 and 28 advances non-stop in the direction of arrow 36 as machine assembly 3 performs its track surfacing work.

As shown in the drawing, both vehicles have regular coupling elements 37 at their respective ends whereby the vehicles may be operated as cars of a train without further adaptation. Any type of coupling used in, or prescribed by, various railroad companies or transportation authorities may be used on the vehicles. In this manner, while the two vehicles may be used mechanically separated from each other during a track surfacing operation, they may also be mechanically coupled for moving from one working site to another. If they have such couplings at both ends, the two vehicles may be readily incorporated as cars into a train.

If the transmission means 13 are physical, such as hoses, cables or the like, it is necessary to make certain that they permit relative movement between vehicles 1 and 2. For instance, if cables or hoses are used, they may be reeled on drums so that they may be lengthened as vehicle 2 advances non-stop along the track while vehicle 1 goes and stops from tamping station to tamping station. This holds true for the transmission means for the track position measuring parameters, odometers, accelerators and the like as well as for the means for connecting central power source 20 to the drives for the vehicles and for the plows. If desired, transmission hoses may be mounted on special mounts to protect them from mechanical damage. Such mounts may consist of link bands which are folded as the vehicles approach each other and are elongated as the vehicles move apart.

In operation, vehicles 1 and 2 are uncoupled, i.e. mechanically separated, and track correction vehicle 1 is intermittently advanced from tie to tie in a conventional manner for track surfacing while vehicle 2 advances non-stop to plow the ballast. During this movement of the machine assembly, the velocity of the non-stop vehicle 2 is preferably so attuned to that of the intermittently advancing vehicle 1 that the distance traveled by the two vehicles over a stretch of surfaced track section is substantially the same, i.e. the distance traveled by vehicle 2 during each tamping stage corresponds to the average distance of adjacent ties (if the tamping machine is of the type tamping one tie at a time). Each tamping stage is defined as the time required for vehicle 1 to advance to the next tie, plus the time required for leveling and/or lining the track at the next tie and tamping the ballast thereat until the machine is ready to advance to the next tie again. During this movement of the machine assembly, vehicle 1 advances intermittently from tie to tie and vehicle 2 advances non-stop along the track. In this manner, the brief accelerations and decelerations of vehicle 1 cannot be transmitted to vehicle 2 during the track surfacing operation, thus leaving instruments 15, 16, such as graphic recorders, perforated tapes, television screens or cameras, indicating track data of all types, free of influence from these accelerations and decelerations, which greatly enhances the quality of the indications. Furthermore, the non-stop movement of vehicle 2 considerably improves the ballast profiling and smoothing operation of plows 27, 28. In some track surfacing operations, it may be preferred to operate vehicle 2 behind vehicle 1 in the corrected track section, for instance to remove excess ballast from newly laid track and to move such ballast to the sides of the track.

Using an independently moving vehicle in the machine assembly is also useful for applying colored markers to indicate the lateral track position or the trend of the track lining, independently of the work of the track correction machine. These markers are applied in spots or lines on the ballast and the ties from vehicle 2 which is mechanically separated from track correction vehicle 1. Instead of applying preferably light-reflective paints by spraying to provide the colored markers, it is also possible to apply synthetic resin markers.

Because of the continuous forward movement of vehicle 2, the operator in cab 17 may concentrate on the indication and control of the track data and the indicated trend of the track position, and the storing of these parameters, thus increasing the accuracy of the operation. The colored markers may be used visually by the operator of the tamping tools for the control thereof, thus making instantaneous corrections of the tamping tool positioning possible. Furthermore, a television screen may also be mounted within view of the tamping tool operator to enable him to survey the track poisition trend.

What is claimed is:

1. A mobile track leveling, lining and tamping apparatus comprising a first vehicle mounted on two undercarriages for mobility on the track in a working direction, track lifting, lining and tamping means mounted on the first vehicle between the two undercarriages, a reference system for controlling the track leveling and lining by the track lifting and lining means, means for measuring parameters of the track position during leveling and lining, a drive for the first vehicle, a second vehicle associated with and preceding the first vehicle in the working direction and forming therewith a single machine assembly while being mechanically separated therefrom, a separate drive for the second vehicle whereby the machine assembly may be operated while the first vehicle advances intermittently and the second vehicle advances non-stop, a ballast plow means mounted on the second vehicle, track position parameter indicating means mounted on the second vehicle, transmission means connecting the measuring means to the indicating means for transmitting the measured parameters whereby the indicating means indicates the track position leveled and lined at the first vehicle, and a common power source on the first vehicle for the drives.

2. The mobile track leveling, lining and tamping apparatus of claim 1, wherein the second vehicle is mounted on two undercarriages for mobility on the track and the ballast plow means is mounted between the two undercarriages of the second vehicle and is arranged for plowing the ballast between the rails of the track.

3. The mobile track leveling, lining and tamping apparatus of claim 1, wherein means is mounted on the second vehicle for applying colored markers along the track.

4. The mobile track leveling, lining and tamping apparatus of claim 1, further comprising coupling means at a forward end of the first vehicle and a rear end of the second vehicle for selectively mechanically coupling the vehicles together.

5. The mobile track leveling, lining and tamping apparatus of claim 1, further comprising coupling elements at the respective ends of the first and second vehicles whereby the vehicles may be operated as part of a train.

6. The mobile track leveling, lining and tamping apparatus of claim 1, further comprising means mounted on the second vehicle for measuring the uncorrected track position.

7. The mobile track leveling, lining and tamping apparatus of claim 1, further comprising an operator's cab on the second vehicle, the track position parameter indicating means being arranged in the cab, and means for operating the ballast plow means from the cab.

8. The mobile track leveling, lining and tamping apparatus of claim 7, wherein the second vehicle is mounted on two undercarriages for mobility on the track in the working direction, and the ballast plow means is mounted between the two undercarriages of the second vehicle.

9. The mobile track leveling, lining and tamping apparatus of claim 1, further comprising additional means for measuring parameters of the track position after leveling and lining mounted on the first vehicle.

10. The mobile track leveling, lining and tamping apparatus of claim 1, further comprising a separate power source for the separate drive.

* * * * *